US006793077B1

(12) United States Patent
Kancsar et al.

(10) Patent No.: US 6,793,077 B1
(45) Date of Patent: Sep. 21, 2004

(54) CHILD-RESISTANT PACKAGING FOR TABLETS

(75) Inventors: Peter Kancsar, Zurich (CH); Laurenz Zellweger, Zurich (CH); Michael Krohn, Zurich (CH); Claudia Schmauder, Zurich (CH); Susanne Marti, Zurich (CH)

(73) Assignee: Alcan Technology & Management Ltd., Neuhausen am Rhienfall (CH)

( * ) Notice: Subject to any disclaimer, the term of this patent is extended or adjusted under 35 U.S.C. 154(b) by 0 days.

(21) Appl. No.: 09/926,583

(22) PCT Filed: May 13, 2000

(86) PCT No.: PCT/EP00/04333

§ 371 (c)(1),
(2), (4) Date: Jun. 3, 2002

(87) PCT Pub. No.: WO00/75039

PCT Pub. Date: Dec. 14, 2000

(30) Foreign Application Priority Data

Jun. 2, 1999 (EP) ..... 99810482

(51) Int. Cl.[7] ..... B65D 83/04

(52) U.S. Cl. ..... 206/531; 206/462; 206/469; 206/807; 206/813; 206/484; 206/820; 206/538

(58) Field of Search ..... 206/460, 461, 206/462, 467, 469, 528, 531, 532, 534.1, 538, 484, 807, 813, 820

(56) References Cited

U.S. PATENT DOCUMENTS 3,835,995 A * 9/1974 Haines ..... 206/536
3,905,479 A 9/1975 Gerner et al.
3,912,082 A 10/1975 Gerner et al.
3,924,747 A 12/1975 Gerner
3,924,748 A * 12/1975 Braverman ..... 206/534.1
4,055,672 A * 10/1977 Hirsch et al. ..... 426/127
4,416,375 A * 11/1983 Braverman et al. ..... 206/534.1
5,242,055 A 9/1993 Pora
5,348,154 A * 9/1994 Jacobs et al. ..... 206/369
5,538,129 A 7/1996 Chester et al.
RE35,445 E 2/1997 Pora
5,702,771 A 12/1997 Shipston et al.
5,744,543 A 4/1998 Huver et al.
5,758,774 A 6/1998 Leblong
5,775,505 A * 7/1998 Vasquez et al. ..... 206/538
5,795,636 A 8/1998 Keller et al.

FOREIGN PATENT DOCUMENTS

WO WO 95-33800 12/1995
WO WO 96-03329 2/1996

* cited by examiner

*Primary Examiner*—Jila M. Mohandesi
(74) *Attorney, Agent, or Firm*—Fisher, Christen & Sabol

(57) ABSTRACT

A child-resistant yet senior-friendly packaging for tablets, capsules or similar pharmaceutical products. The packaging is a blister pack (12) with at least one cup (24) that receives tablets in an external package (10), arranged between a base part (14) and an intermediate part (16), and that is closed by a cover film (26) that can be pressed through. The intermediate part (16) is covered by a cover part (18). A first adhesive (30) is arranged between the base part (14) or the blister pack (12) and the intermediate part (16). A second adhesive (32) is arranged between the intermediate part (16) and the cover part (18). The second adhesive (32), in the closed state of the external package (10), has a lower adhesiveness vis-à-vis the first adhesive (30) and, once the cover part (18) is released from the intermediate part (16), a higher adhesiveness vis-à-vis the first adhesive (30).

9 Claims, 5 Drawing Sheets

CHILD-RESISTANT PACKAGING FOR TABLETS

Figure 1:
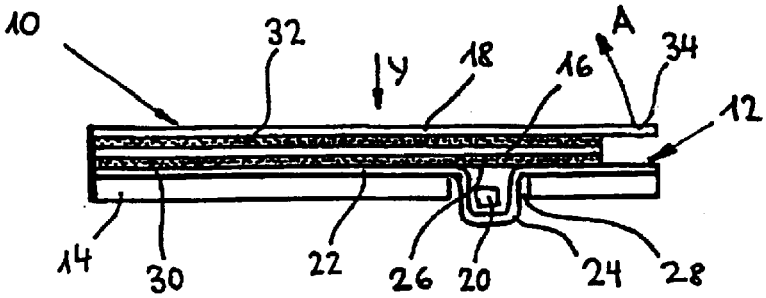

This is a 371 of International Application No. PCT/EP00/04333, field on May 12, 2000, that has benefit of European Patent Application No. 99810482.2, filed on Jun. 2, 1999.

The invention concerns a child-safe packing for tablets, capsules and similar pharmaceutical products with a blister pack with at least one cup to hold the tablets or capsules sealed by a push-through cover film, where over the blister pack fitted with an outer pack is arranged an intermediate part and the intermediate part is covered by a cover part, where the cover from of the blister pack faces towards the intermediate part, where between the blister pack and the intermediate part is arranged a first adhesive and between tithe intermediate part and the cover part is arranged a second adhesive, and where when the outer pack is closed, the second adhesive has a power adhesive force than the first adhesive.

The invention also concerns a child-safe packing for tablets, capsules and similar pharmaceutical products, with a blister pack with at least one cup to hold the tablets sealed by a push-through cover film, where over the blister pack fitted with an outer pack is arranged an intermediate part, where the cover film of the blister pack faces towards the intermediate part, and where between the blister pack and the intermediate part is arranged a first adhesive.

The invention also concerns a child-safe packing for tablets, capsules and similar pharmaceutical products with a blister pack with at least one cup to hold the tablets sealed by means of a push-through cover film, where the blister pack in an outer pack is arranged between a base part and a cover part, where the cover part is covered by a sealing part, where the cover film of the blister pack faces towards the cover part, and where, with the outer pack closed, between the base part or the blister pack and the cover part is arranged a first adhesive.

The invention further concerns a child-safe packing for tablets, capsules and similar pharmaceutical products with a blister pack with at least one cup to hold the tablets closed by a push-through cover film, where over the blister pack fitted with an outer pack is arranged a first cover part and the first cover part is overlaid by a second cover part, and where the cover film of the blister pack faces towards the first cover part.

The invention also concerns a child-safe packing for tablets, capsules and similar pharmaceutical products with a blister pack with at least one cup to hold the tablets closed by a push-through cover film, where the blister pack is arranged in an outer pack between a base part and a first cover part, where the first cover part is overlaid by a second cover part, and where the cover film of the blister pack faces towards the first cover part.

The danger of unsupervised consumption of drugs is undisputed, where in particular small children are greatly exposed to this potential risk especially when drugs are left lying around.

Blister packs have become the predominant form of packaging for tablets and capsules. Push-through packs, in which the tablets are pushed through a cover film from a cup in the base of the packing, have become very common. In other known blister packs a cover film is removed by peeling. Other blister packs have a notch as a tear aid.

The possibilities exploited today for increasing the child-safety of the said blister packs for tablets and capsules consist of rendering opening more difficult by measures which require increased force, e.g. thicker push-through films, stronger adhesion of peel films or high tear resistance at tear notches.

Packs which can only be opened with increased use of force are indeed child-safe but can constitute a problem for the elderly.

A child-safe packing of the type described initially is known from U.S. Pat. No. 3,912,082.

The invention is therefore based on the task of creating a child-safe packing of the type described initially which can easily be opened by the elderly. Essentially, the packing is structured such that its opening requires a combination skill, or simultaneous movements must be performed, or procedures which require coordination or combination of individual steps.

A first solution to the task according to the invention is a child-safe packing for tablets, capsules and similar pharmaceutical products with a blister pack with at least one cup to hold the tablets sealed by a push-through cover film, where over the blister pack fitted with an outer pack is arranged an intermediate part and the intermediate part is covered by a cover part, where the cover film of the blister pack faces towards the intermediate part, where between the blister pack and the intermediate part is arranged a first adhesive and between the intermediate part and the cover part is arranged a second adhesive, and where when the outer pack is closed, the second adhesive has a lower adhesive force than the first adhesive, after separating the cover part from the intermediate part, the second adhesive has a higher adhesive force than the first adhesive.

A second solution to the task according to the invention is a child-safe packing for tablets, capsules and similar pharmaceutical products with a blister pack with at least one cup to hold the tablets sealed by a push-through cover film, where over the blister pack fitted with an outer pack is arranged an intermediate part, where the cover film of the blister pack faces towards the intermediate part, and where between the blister pack and the intermediate part is arranged a first adhesive, the intermediate part is partly covered by a removable separating part and a cover part lies on the separating part, in that between the intermediate part and the separating part is arranged a second adhesive, and between the intermediate part not covered by the separating part and the separating part and the cover part is arranged a third adhesive, where the third adhesive has a lower adhesive force than the first adhesive and the second adhesive has a higher adhesive force than the first adhesive.

To achieve greater stability of the packing, the blister pack can be arranged in an outer pack between a base part and the intermediate part and the first adhesive can be arranged between the base part or blister pack and the intermediate part.

A third solution to the task according to the invention is a child-safe packing for tablets, capsules and similar pharmaceutical products with a blister pack with at least one cup to hold the tablets sealed by means of a push-through cover film, where the blister pack in an outer pack is arranged between a base part and a cover part, where the cover part is covered by a sealing part, where the cover film of the blister pack faces towards the cover part, and where, with the outer pack closed, between the base part or the blister pack and the cover part is arranged a first adhesive, the sealing part is covered by a tear-off part, in that between the base part and the sealing part is arranged a second adhesive, where the second adhesive has a higher adhesive force than the first adhesive, and the sealing part, with the outer pack closed is folded about a first fold line (k) and on opening the outer pack, about a second fold line (l), and where after folding the sealing part about the second fold line (l), the second adhesive is arranged between the sealing part and the cover part.

A fourth solution to the task according to the invention is a child-safe packing for tablets, capsules and similar pharmaceutical products with a blister pack with at least one cup to hold the tablets closed by a push-through cover film, where over the blister pack fitted with an outer pack is arranged a first cover part and the first cover part is overlaid by a second cover part, and where the cover film of the blister pack faces towards the first cover part, the second cover part is overlaid by a sealing part lying on this, in that the sealing part has a removal opening opposite the cup of the blister pack and sealed by the second cover part when the outer pack is closed, and optionally covered by a push-through opening seal, in that the two cover parts are connected together at one end and at the other end each is connected to one end of the blister pack or the sealing part, and the blister pack is connected to the sealing part at their other ends to form grip tabs, in that the grip tabs of the two cover parts lie within a loop formed by the blister pack and sealing part, and in that with the outer pack closed, between the first cover part and the blister pack and between the second cover part and the sealing part there is a releasable connection which is separated after opening the outer pack after pulling on the grip tabs, where in this open position of the outer pack, the cover film over the cup of the blister pack lies opposite the removal opening.

A variant of the invention with greater stability is a child-safe packing for tablets, capsules and similar pharmaceutical products with a blister pack with at least one cup to hold the tablets closed by a push-through cover film, where the blister pack is arranged in an outer pack between a base part and a first cover part, where the first cover part is overlaid by a second cover part, and where the cover film of the blister pack faces towards the first cover part, the second cover part is overlaid by a sealing part lying on this, in that the first sealing part has a removal opening opposite the cup of the base part and sealed by the second cover part when the outer pack is closed, and optionally covered by a push-through opening seal, in that the two cover parts are connected together at one end and at the other end each is connected to one end of the base part or sealing part, and the base part is connected to the sealing part at their other ends to form grip tabs, in that the grip tabs of the two cover parts lie within a loop formed by the base part and the sealing part and in that with the outer pack closed, between the first cover part and the base part and between the second cover part and the sealing part there is a releasable connection which is separated after opening the outer pack after pulling on the grip tabs, where in this open position of the outer pack the cover film over the cup of the base part lies opposite the removal opening.

In a first preferred embodiment of: the fourth solution to the task according to the invention, the connection between the first cover part and the blister pack or the base part and between the second cover part and the sealing part is glued or sealed separably.

In a second preferred embodiment of the fourth solution to the task according to the invention, when the outer pack is closed an adhesive is arranged between the first cover part and the blister pack or the base part and between the second cover part and the sealing part, and after the outer pack has been opened after pulling on the grip tabs, between the two cover parts or between the base part and sealing part, where in this open position of the outer pack the cover film over the cup of the blister pack lies opposite the removal opening.

The principle common to all four solutions according to the invention lies in the use of adhesives of different adhesion force or separable glued or sealed laminates. The opening of the packs according to the invention requires a combination ability in the sense that before pressing through the tablets, various parts of the packing must be separated from each other and pressed back together.

In the packings with a base part, the cup of the blister pack preferably protrudes outwards from the plane formed by the base part, where in the simplest case the cup of the blister pack penetrates an opening in the base part. If the base part consists of a deformable material, a cup can also be formed from this and the cup of the blister pack arranged in the cup of the base part.

The outer packs can be produced particularly economically from a single cut-out.

At least two packings can be combined into multi-portion packs, where the individual packings are arranged next to each other in a strip pack and preferably can be separated from the strip pack along a weakening line, preferably a perforation line.

For production of the packing according to the invention, rigid, semi-rigid and flexible materials known today for the production of packaging, in the form of sheets, films, laminates or other layer materials in a thickness from a few mm to a few mm, preferably from 8 mm to 3 mm, can be used. Examples of film-like materials are metal foils such as aluminum foil. Other examples of film-like materials are paper, semi-cardboard and cardboard. Particularly important are plastic containing films, e.g., those based on polyolefins such as polyethylenes or polypropylenes, polyamides, polyvinyl chloride, polyesters such as polyalkylene terephthalates and, in particular, polyethylene terephthalate. The plastic-containing films can be monofilms of plastics, laminates of two or more plastic films, laminates of metal and plastic films. The individual layers of the film-like A materials can be attached to each other by means of adhesives, pastes, adhesive promotion agents and/or by extrusion coating, coextrusion or laminating, etc. Suitable plastic films are, for example, non-oriented or axially or biaxially oriented monofilms or laminates of two or more non-oriented or axially or biaxially oriented films of plastics based on polyolefins such as polyethylenes or polypropylenes, polyamides, polyvinyl chloride, polyesters such as polyalkylene terephthalates and, in particular, polyethylene terephthalate, cyclo-olefin-copolymers (CO) and polychlorotrifluoroethylene (PCTFE, trademark ACLAR).

Particularly suitable for the base parts of blister packs are transparent plastics with good molding properties such as polyethylene, polypropylene, cyclo-olefin-copolymers (COC), polyvinyl chloride, polyethylene terephthalate, polyainide and laminates made from said materials, e.g., PVC and polychlorotrifluoroethylene (PCTFE) or PVC and PVDC (polyvinyldichloride). For non-transparent blister packs, for example, laminates are used of an aluminum film coated on both sides with a plastic film with, for example, the structure polyamidelaluminum/PVC or pigmerited plastic films. The cover film is usually an aluminum of a thickness of, e.g., 20 $\mu$m which can be painted and/or coated with a hot seal lacquer.

All of the above film-like materials such as paper, semi-cardboard, cardboard and plastic films in the form of monofilms, laminates, etc., can have at least one further continuous layer of ceramic materials, sputtered or deposited from a vacuum in a thickness of approximately 5 to 500 nm (nanometers), for example, $Al_2O_3$ or $SiO_x$, where x is a figure between 1.5 and 2. These layers of ceramic materials have barrier properties and prevent the diffusion of gases and water vapors through the packing.

Figure 2:
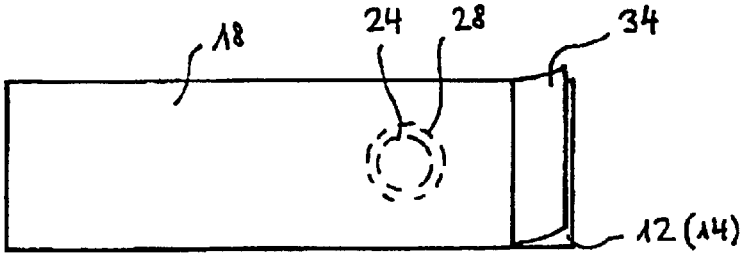
Figure 3:
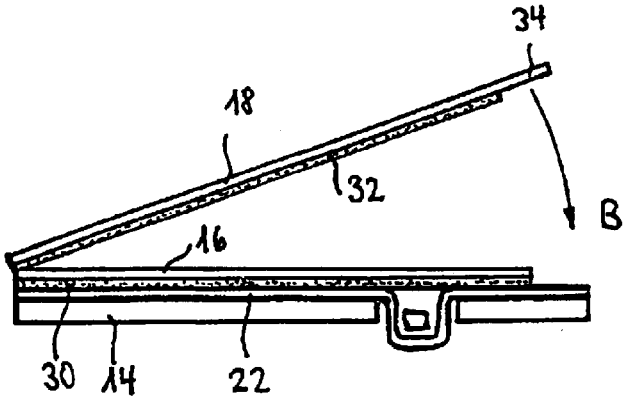
Figure 4:
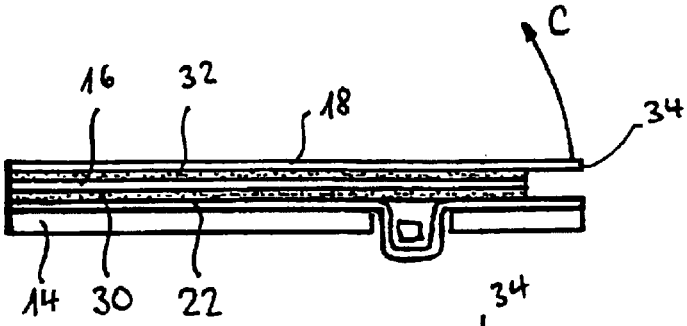
Figure 5:
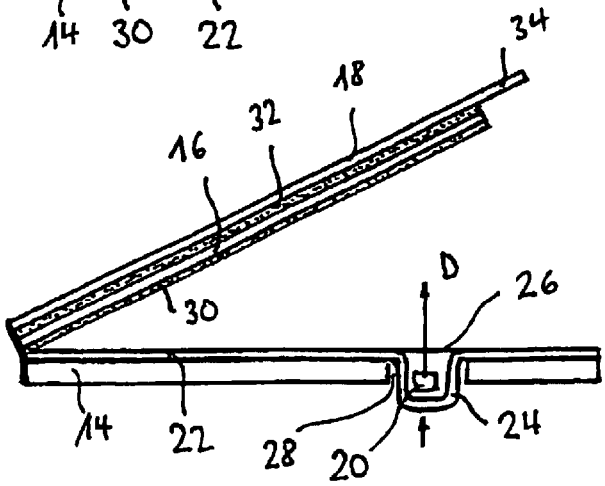
Figure 7:
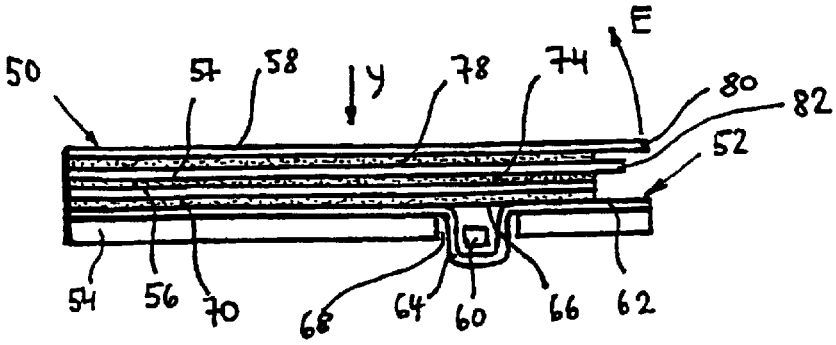
Figure 6:
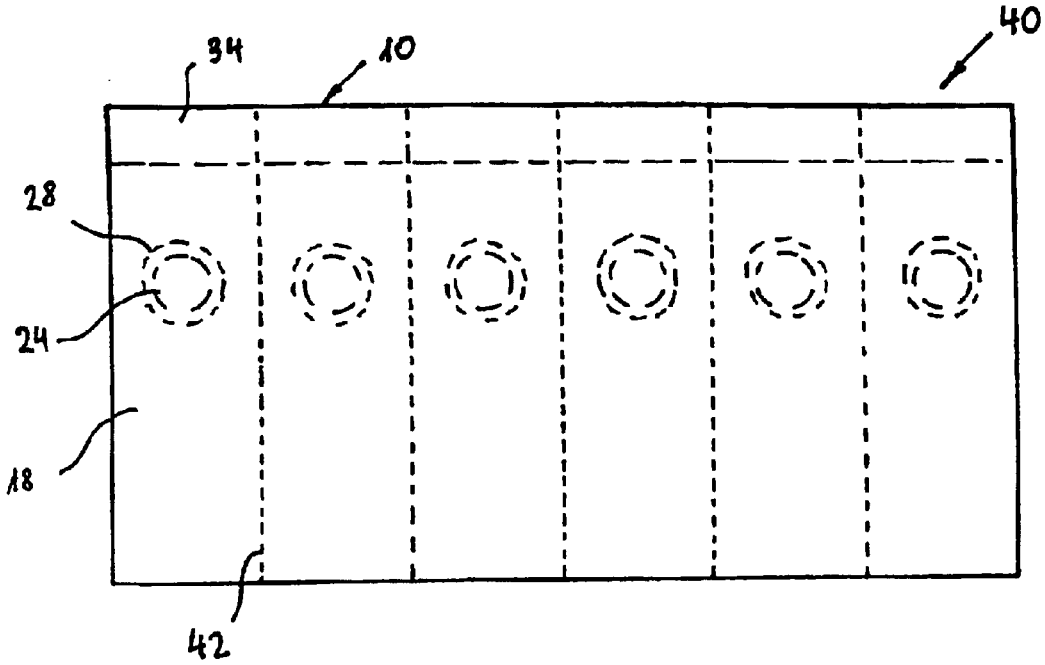

Further advantages, features and details of the invention arise from the description of preferred embodiments below and the drawings; these show diagrammatically FIG. 1 a longitudinal section through a first embodiment of the blister pack with outer pack;

FIG. 2 a top view onto the outer pack of FIG. 1 of direction y;

FIGS. 3–5 a longitudinal section through the blister pack with outer pack as in FIG. 1 in successive opening positions, FIG. 6 a top view onto a blister pack with outer pack in FIG. 1 designed as a multi-portion pack, FIG. 7 a longitudinal section through a second embodiment of a blister pack with outer pack,.

Figure 8:
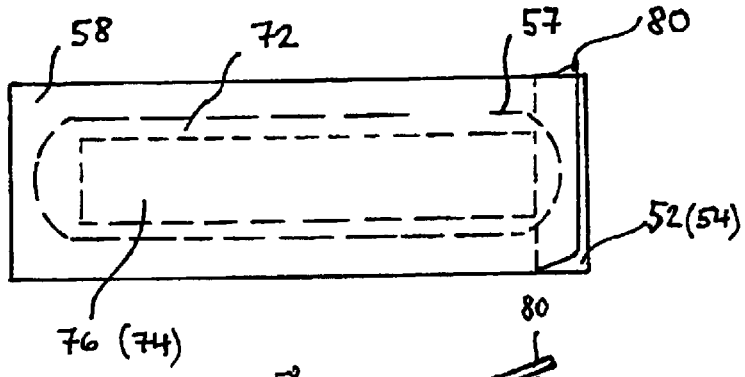
Figure 9:
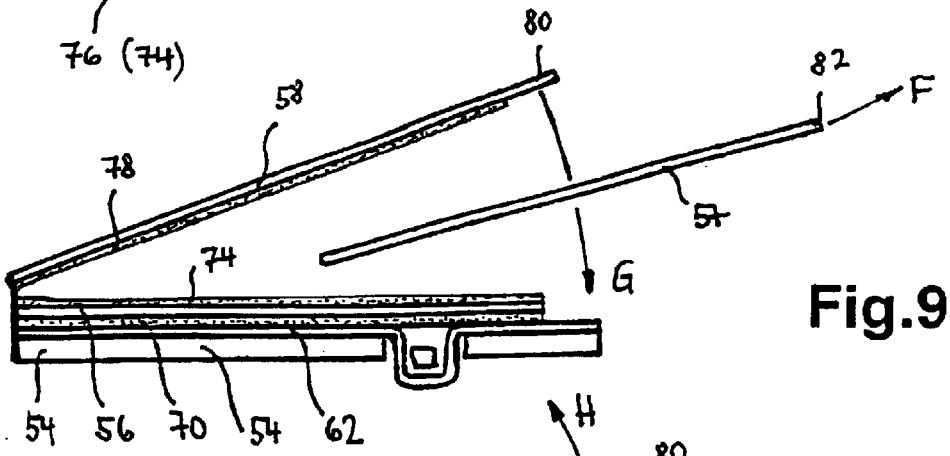
Figure 10:
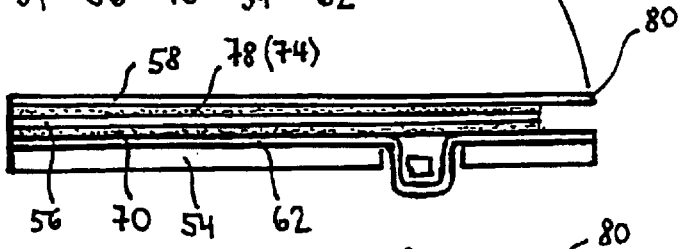
Figure 11:
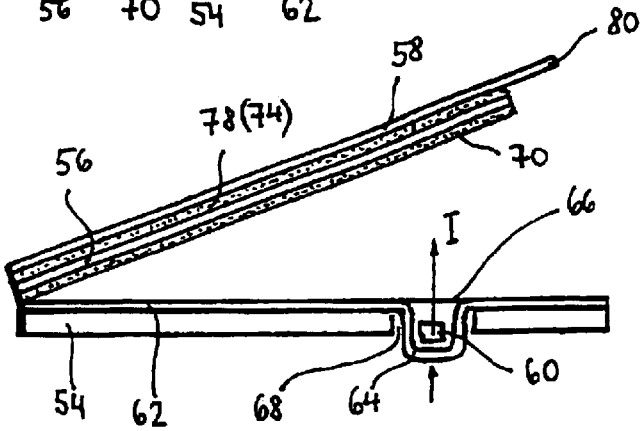
Figure 12:
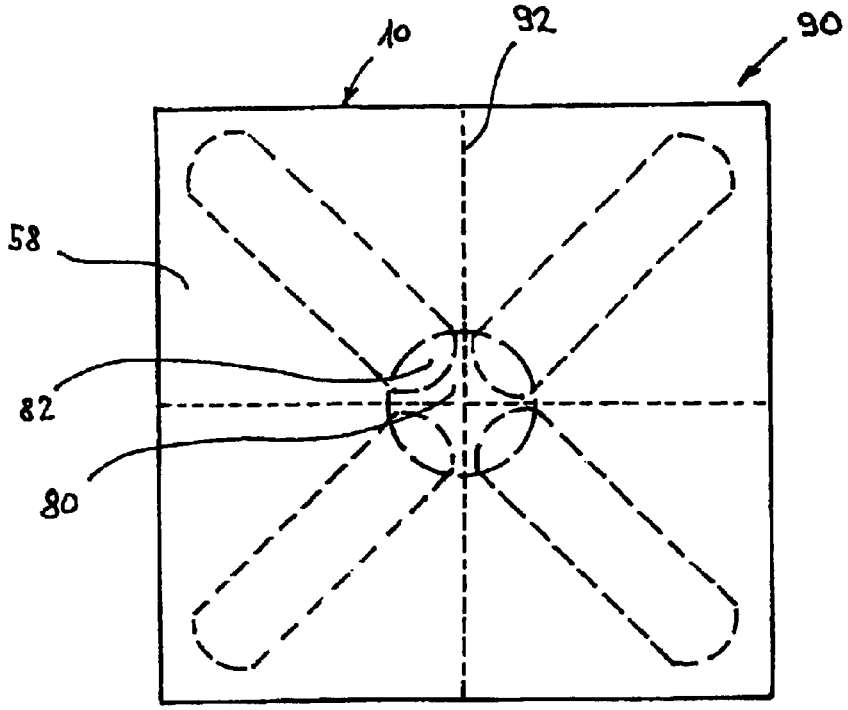
Figure 13:
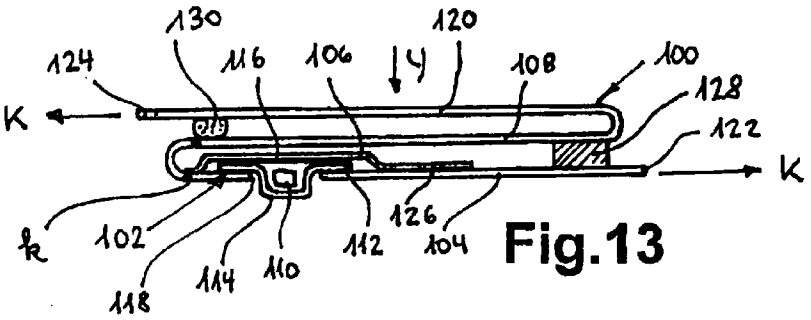
Figure 14:
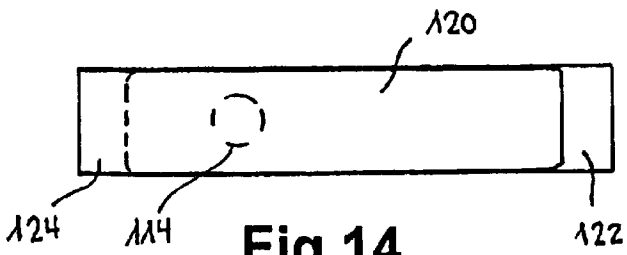
Figure 15:
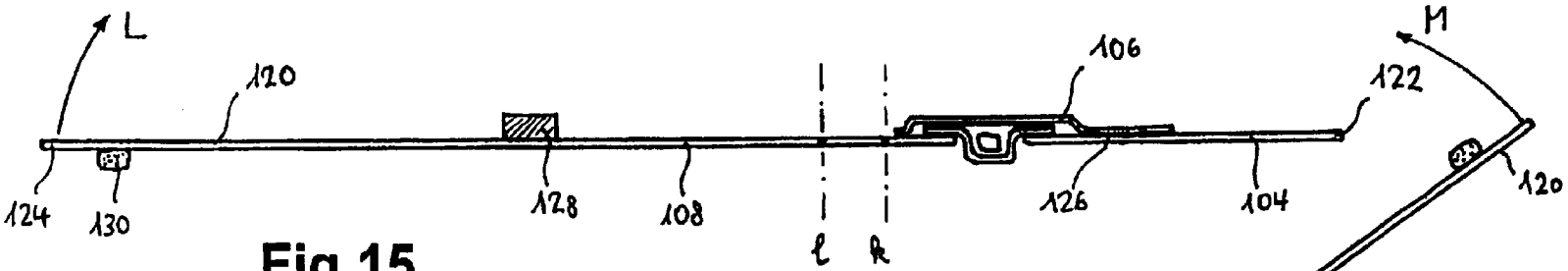
Figure 16:
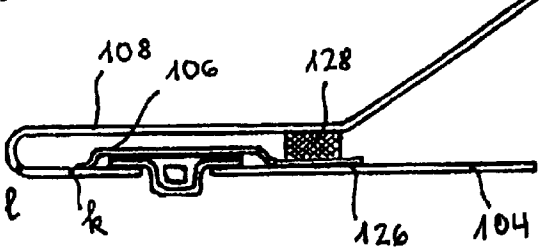
Figure 17:
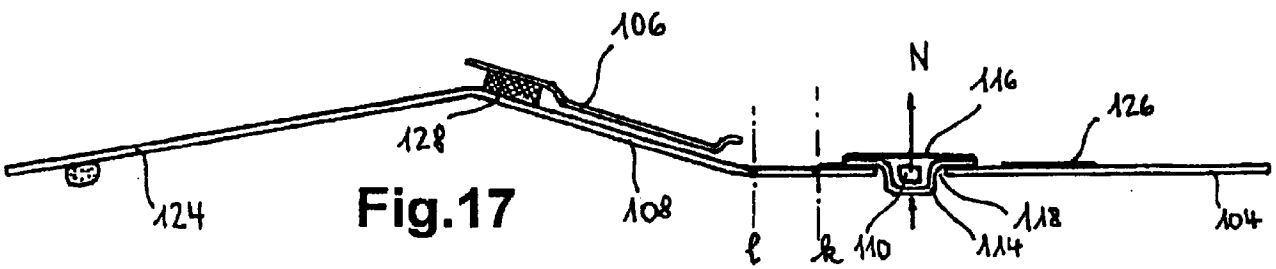
Figure 18:
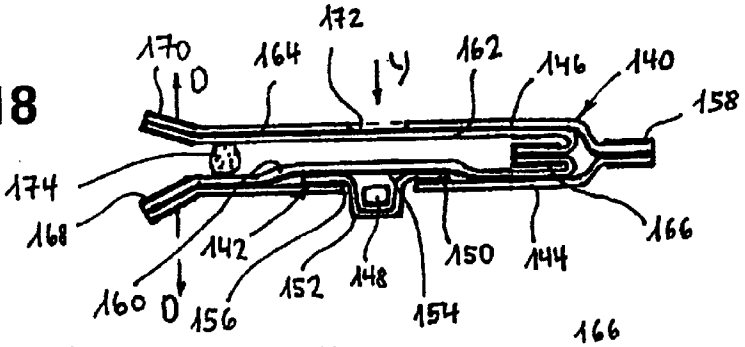
Figure 19:
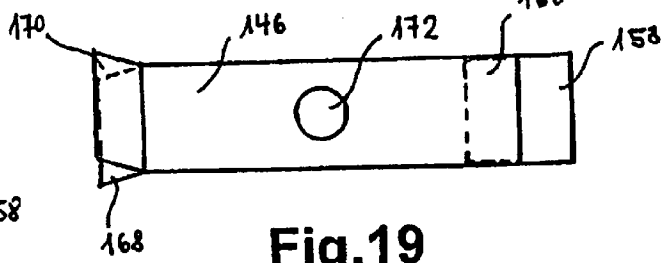
Figure 22:
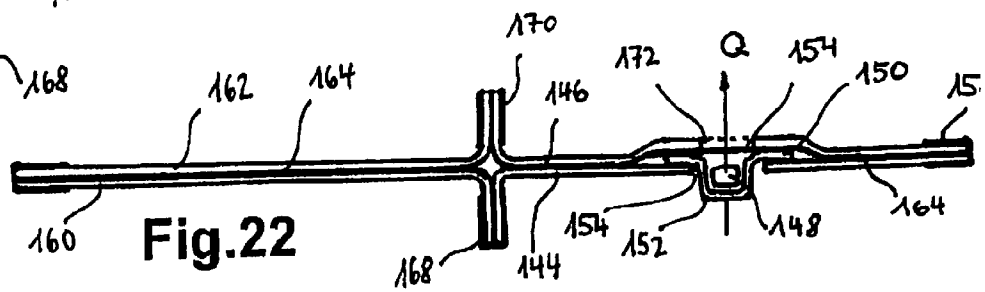
Figure 21:
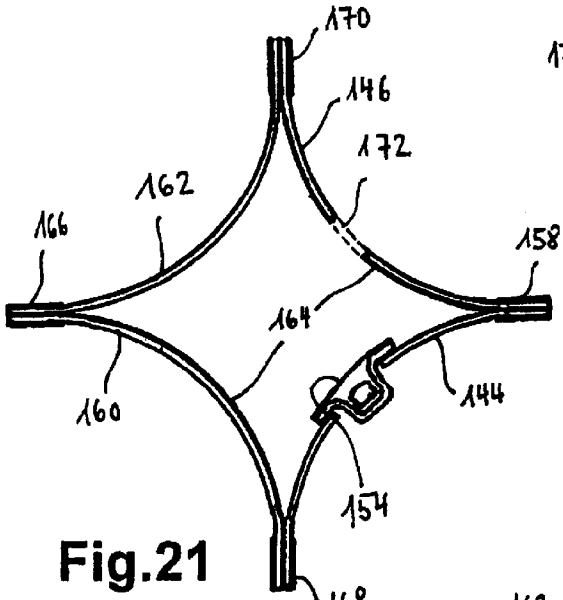
Figure 20:
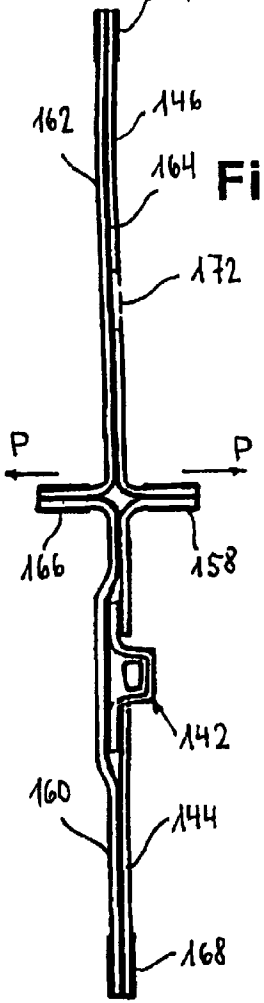

FIG. 8 a top view onto the outer pack of FIG. 7 in direction y;

FIGS. 9–11 a longitudinal section through the blister pack with outer pack of FIG. 7 in successive opening positions;

FIG. 12 a top view onto a blister pack with outer pack designed as a multi-portion pack as in FIG. 7;

FIG. 13 a longitudinal section through a third embodiment of a blister pack with outer pack;

FIG. 14 a top view onto the outer pack of FIG. 13 in direction y;

FIGS. 15–17 a longitudinal section through the blister pack with outer pack of FIG. 13 in successive opening positions;

FIG. 18 a longitudinal section through the fourth embodiment of a blister pack with outer pack, FIG. 19 a top view onto the outer pack of FIG. 18 in direction y;

FIGS. 20–22 a longitudinal section through the blister pack with outer pack of FIG. 18 in successive opening positions.

A first embodiment of an outer pack 10 for a blister pack 12 shown in FIGS. 1 to 5 of essentially strip-like shape has a base part 14 of, for example, cardboard, a film-like intermediate part 16 and an also film-like cover part 18—both films made, for example, made from polyethylene terephthalate (PET). The blister pack 12—in the example shown, a single-portion pack for a tablet 20—has a base part 22 of, for example, polyvinyl chloride (PVC) with a cup 24 molded from this to hold a tablet 20, and a cover film 26 of, for example, aluminum sealed or glued to the base part 22. The cup 24 of the blister pack 12 penetrates a base opening 28 adapted to the periphery of the cup 24 in the base part 14 of the outer pack 10 and protrudes outward from the base part 14. The base part 22 of the blister pack 12 lies on the inside of the base part 14 of the outer pack 10 and is at least partly glued to this by way of a permanent adhesive based, for example, on polyurethane. Instead of the base opening 28, where the material allows, a cup can also be formed from the base part 14, i.e., the cup 24 of the blister pack 12 would in this case be held by the cup in the base part 14.

The intermediate part 16 is glued to the base part 14 or the blister pack 12 by way of a first adhesive 30. The cover part 18 lying on the intermediate part 16 is glued by way of a second adhesive 32 to the intermediate part 16 and projects over the base part 16 to form an adhesive-free tear tab 34. At the end of the outer pack 10 remote from the tear tab 34, the base part 14, blister pack 12, intermediate part 16 and cover part 18 are permanently glued to each other.

In the closed outer pack 10, the second adhesive 32 between the cover part 18 and intermediate part 16 has a lower adhesion force than the first adhesive 30 between the intermediate part 16 and base part 14 or blister pack 12. The first adhesive 30 is for example an adhesive based on polyacrylate, other adhesive resins or an adhesive with a micro-encapsulation system. The second adhesive 32 is a reactive adhesive, the adhesion force of which for example rises in an oxygen atmosphere. The increase in adhesion force can be also caused however by other factors such as pressure, relative humidity etc.

To remove the tablet 20 first the cover part 18 is held at its tear tab 34 and through an opening movement performed in arrow direction A separated from the intermediate part 16 below. In this position the second adhesive 32 is freely exposed to the ambient atmosphere, whereby its adhesion force increases due to a reaction with oxygen such that it exceeds the adhesion force of the first adhesive 30. In a next step the cover part 18 with the reacted second adhesive 32 is re-placed on the intermediate part 16 in arrow direction B and connected with the intermediate part by way of the reacted second adhesive 32. In a variant with micro-encapsulation system, the tear tab 34 must be pressed firmly onto the intermediate part for example by pushing or rubbing between fingers. In a subsequent step the tear tab 34 of the cover part 18 is held again and pulled away from the base in an opening movement performed in arrow direction C. As the adhesion force of the second reacted adhesive 32 is now greater than the adhesion force of the first adhesive 30, in the opening movement in arrow direction C a separation occurs between the intermediate part 16 and the base part 14 or blister pack 12. In this process the cover film 26 of the blister pack 12 is exposed. In this open position the tablet 20 can be pushed through the cover film 26 by finger pressure on the cup 24 in arrow direction D and ejected. In a variant the cover film 26 is separated from the blister pack 12 in the opening movement in arrow direction C so that the tablet 20 can be removed without pushing through the cover film 26.

The base part 14 which serves for stability of the outer pack 10 can be omitted in another embodiment not shown in the drawing. Here, the cover part 18 can be connected as one piece with the blister pack 12 or its base part 22 and form a loop i.e. the outer pack consists of one and the same material e.g. the blister pack or its base part.

FIG. 6 shows a strip-like pack 40 with six individual packings according to FIG. 1 arranged next to each other. These can be separated from each other by linear perforations 42. The individual outer packs 10 can however also be opened without needing to be separated from the packing strip 40.

A second embodiment shown in FIGS. 7 to 11 of an outer pack 50 for a blister pack 52 of essentially strip-like structure is fitted with base part 54, an intermediate part 56, a separate part 57 and a cover part 58. The blister pack 52—in the example shown, a single-portion pack for a tablet 60—has a base part 62 of, for example, polyvinyl chloride (PVC) with a cup 64 formed from this to hold the tablet 60 and a cover film 66 of, for example, aluminum sealed or glued to the base part 62. The cup 64 of the blister pack 52 penetrates a base opening 68 adapted to the periphery of the cup in the base part 54 of the outer pack 50 and protrudes outward from the base part 54. The base part 62 of the blister pack 60 lies on the inside of the base part 54 of the outer pack 50 and is at lest partly glued to this by way of a permanent adhesive based, for example, on polyurethane. Instead of the base opening 68, where the material allows, a cup can also be formed from the base part 54, i.e., the cup 64 of the blister pack 52 would in this base be held by the cup in base part 54.

The intermediate part 56 is glued to the base part 54 or the blister pack 52 by way of a first adhesive 70. The separating part 57 lying on the intermediate part 56 covers a zone 76 separated from an edge area 72 and with a second adhesive 74. The cover part 58 lying on the intermediate part 56 and separating part 57 is glued by way of a third adhesive 78 to the edge area 72 of the intermediate part 56 and projects over the intermediate part 56 to form an adhesive-free tear tab 80. At the end of the outer pack 50 remote from the tear tab 80, the base part 54, intermediate part 56 and cover part 58 are permanently glued together. The separating part 57 covering the second adhesive 74 projects over the intermediate part 56 to form an adhesive-free grip tab 82.

In the closed outer pack 50 the third adhesive between the cover part 58 and the intermediate part 56 has a lower adhesion force than the first adhesive 70 between the intermediate part 56 and the base part 54 or blister pack 52. The second adhesive 74 of the zone of the intermediate part 56 covered by a separating part 57 has a greater adhesion force than the first adhesive 70, where the material for the separating part 57 is selected so that compared with the second adhesive 74 only a very low adhesion force is generated, and compared with the third adhesive 78 practically no adhesion force. The adhesives 70, 74, 78 are for example adhesives based on polyacrylate or other adhesive resins.

To remove the tablet 60 first the cover part 58 is held at its tear tab 80 and by an opening movement performed in arrow direction E separated from the intermediate part 56 below and the separating part 57 lying on this. In the next step the separating part 57 is held at its grip tab 84 and pulled in arrow direction F away from the intermediate part 56 to expose zone 76 with the second adhesive 74 of the intermediate part 56. In a variant with micro-encapsulation system, the tear lab 80 must be pressed on firmly. In a subsequent step the cover part 58 is replaced in arrow direction G on the intermediate part 56 with the now exposed zone 76 with the second adhesive, 74, and connected to the intermediate part 56 by way of the exposed second adhesive 74. In a subsequent step the tear tab 80 of the cover part 58 is held again and pulled away from the base in an opening movement performed in arrow direction H. As the adhesion force of the second adhesive 74 is greater than the adhesion force of the first adhesive 70, in the opening movement in arrow direction H a separation occurs between the intermediate part 56 and the base part 54 or blister pack 52. In this process the cover film 66 of the blister pack 52 is exposed. In this open position the tablets 60 can be pushed by finger pressure on cup 64 in arrow direction I through the cover film 66 and ejected. In a variant the cover film 66 is already separated from the blister pack 52 in the opening movement in arrow direction I so that the tablet 60 can be removed without pushing through the cover film 66.

The base part 54 which serves for stability of the outer pack 50 can be omitted in another embodiment not shown in, the drawing. Here, the cover part 58 can be connected as one piece with the blister pack 52 or its base part 62 and form a loop i.e. the outer pack consists of one and the same material e.g. the blister pack or its base part.

FIG. 12 shows a pack 90 with four square individual packings according to FIG. 7. These can be separated from each other by linear perforations 92. The individual outer packs 10 can however also be opened without needing to be separated from the pack of four 90. The tear tab 80 of the cover part 58 and grip tab 82 of the separating part 57 are here facing towards the centre of the pack 90 whereby the pack is easy to produce.

A third embodiment shown in FIGS. 13 to 17 of an outer pack 100 for blister pack 102 of essentially strip-like shape is fitted with a base part 104, a cover part 106, a sealing part 108 and a tear-off part 120. The blister pack 102—in the example shown, a single-portion pack for a tablet 110—has a base part 112 of, for example, polyvinyl chloride (PVC) with a cup 114 molded from this to hold the tablets 110, and a cover film 116, for example, of aluminum sealed or glued to the base part 112. The cup 114 of the blister pack 102 penetrates a base opening 118 adapted to the periphery of the cup 114 in the base part 104 of the outer pack 100 and protrudes outwards from the base part 104. The base part 112 of the blister pack 102 lies on the inside of the base part 104 of the outer pack 100 and is at least partly glued to this. Instead of the base opening 118, where the material allows, a cup can also be formed from the base part 104, i.e., the cup 114 of the blister pack 102 would in this case be held by the cup in the base part 104.

The base part 104, sealing part 108 and tear-off part 120 are connected together as one piece as strips of for example cardboard and when the outer pack 100 is closed are laid over each other in three layers to form a double loop, where the fold is such that the free ends of the base part 104 and tear-off part 120 project at the sides in the strip longitudinal direction as grip tabs 122, 124. The film-like cover part 106 of for example polyethylene terephthalate (PET) extends, covering the blister pack 102, over part of the base part 104 and is glued by way of a first adhesive 126 with the base part 104 or blister pack 102 and the cover part 106. With the outer pack 100 closed, the sealing part 108 is folded about a first fold line k and by way of a second adhesive 128 glued to the base part 104 below. This second adhesive 128 is arranged in the form a transverse strip on the sealing part 108 at the transition to the tear-off part 120. The tear-off part 120 lying on the sealing part 108 is glued to this by way of an adhesive point 130 lying in the area of the transition to the base part 104. The adhesive point 130 can for example take the form of a seal. The second adhesive 128 has a higher adhesion force than the first adhesive 126 between the cover part 106 and base part 104.

To remove the tablet 110, first the grip tabs 122 and 124 are held and pulled apart on both sides in arrow direction K. In this process the tear-off part 120 becomes detached at adhesive point 130 from the sealing part 108 and the sealing part 108 detached from the base part 104 at the strip of the second adhesive 128. The outer pack 100 extended into a strip of maximum length is now folded back in arrow direction L about a second fold line I. The position of fold line I is arranged so that after folding, the strip-like second adhesive 128 applied to the closing strip now lies on the cover part 106 and is glued to this after a slight pressure between two fingers.

In a further opening step the tear-off part 120 is held and pulled away from the base in an opening movement performed in arrow direction M. As the adhesion force of the second adhesive 128 is greater than the force of the first adhesive 126, the opening movement in arrow direction M leads to a separation between the cover part 106 and the base part 104 or blister pack 102. In this process the cover film 116 of the blister pack 102 is exposed. In this open position the tablet 110 can be pushed through the cover film 116 by finger pressure on cup 114 in arrow direction N and ejected.

A fourth embodiment shown in FIGS. 18 to 22 of an outer pack 140 of, for example, cardboard for a blister pack of 142 essentially strip-like shape has a base part 144 and a sealing part 146. The blister pack 142—in the example shown, a single portion pack for a tablet 148—has a base part 150 of, for example, polyvinyl chloride (PVC) with a cup 152 formed from this to hold the tablet 148, and a cover film 154 of, for example, aluminum sealed or glued to the base part 150. The cup 152 of the blister pack 142 penetrates a base opening 156 adapted to the periphery of the cup 152 in the base part 144 of the outer pack 140 and protrudes outwards from the base part 144. The base part 150 of the blister pack 142 lies on the inside of the base part 144 of the outer pack 140 and is at least partly glued to this. Instead of the base opening 156, where the material allows, a cup can also be formed from the base part 144, i.e., the cup 152 of the blister pack 142 would in this case be held by the cup in the base part 144.

The sealing part 146 is brought together with the base part 144 in a first grip tab 158 and fixed here. Two film-like cover parts 160, 162 are connected by way of an adhesive 164 with the base part 144 or blister pack 142 and sealing part 146 and brought together and fixed in a second grip tab 166 opposite the first grip tab 158. At their ends remote from the first and second grip tabs 158, 166, the cover parts 160, 162 and the base part 144 or sealing part 146 connected to these by way of the adhesive 164 are brought together and fixed in a third and fourth grip tab 168, 170.

The base part 144 of the outer pack 140 with the sealing part 146 forms a loop where the base part 144 and sealing part 146 are approximately parallel to each other. The sealing part 146 has a removal opening 172 opposite the base opening 156 or cup 152. This removal opening is closed by the cover part 162. The sealing part 146 is fixed to the base part 144 in the area of the third and fourth grip tabs 168, 170, opposite each other in the closed outer pack 140, by way of an adhesive point 174 to enclose the second grip tab 166. The adhesive point 174 can for example also take the form of a seal.

To remove the tablet 148 the third and fourth grip tabs 168, 170 are held and pulled apart in arrow direction O, exposing the second grip tab 166. In a second step the first and second grip tabs 156, 166 are held and pulled apart in arrow direction P. In this process the cover parts 160, 162 are detached from the base part 144 and sealing part 146 so that on complete extension in arrow direction P the base part 144 lies opposite the sealing part 146 and is glued to this by way of the adhesive 164. In the same way at the end of the stretch process the two cover lo parts 160, 162 lie on each other and are glued together by way of the adhesive 164. In this process the removal opening 172 is opened and now—separated only by the cover film 154—exposes the tablet 148 in cup 152 opposite. In this open position the tablet 148 can be pushed by finger pressure on cup 152 in arrow direction Q through the cover film 154 and ejected through the removal opening 172. The removal opening 172 can also be covered by a push-through opening seal. This additional seal is for example limited by a weakening line, e.g. a perforation line, and is separated at the same time as the cover film 154 is pushed through.

In a variant of the latter embodiment of an outer pack 140 the base part 144 is omitted i.e. the blister pack 142 or its base part 150 extends between the grip tabs 158, 168.

Instead of the adhesive 164, the base part 144 or blister pack 142 can be releasably connected with the first cover part 160 and second cover part 162 with the sealing part 146, where this connection is for example glued or sealed. In the case of a seal, a laminate is formed which is separable at the sealing layer or seam.

What is claimed is:

1. A child-safe packing for tablets, capsules and similar pharmaceutical products with a blister pack (12) with at least one cup (24) to hold the tablets (20) sealed by a push-through cover film (26), where over the blister pack (12) fitted with an outer pack (10) is arranged an intermediate part (16) and the intermediate part (16) is covered by a cover part (18), where the cover film (26) of the blisterpack (12) faces towards the intermediate part (16), where between the blister pack (12) and the intermediate part (16) is arranged a first adhesive (30) and between the intermediate part (16) and cover part (18) is arranged a second adhesive (32), and where when the outer pack (10) is closed, the second adhesive (32) has a lower adhesive force than the first adhesive (30) and after separating the cover part (18) from the intermediate part (16), the second adhesive (32) has a higher adhesive force than the first adhesive (30).

2. The packing according to claim 1, wherein the blister pack (12, 52) in the outer pack (10, 50) is arranged between a base part (14, 54) and the intermediate part (16, 56), and that the first adhesive (30, 70) is arranged between the base part (14, 54) or blister pack (12, 52) and the intermediate part (16, 56).

3. The packing according to claim 1, wherein the cup (24, 64,114, 152) of the blister pack (12, 52, 102, 142) protrudes outwards from the plane formed by the base part (14, 54, 104, 144).

4. The packaging according to claim 3, wherein the cup (24, 64, 114, 152) of the blister pack (12, 52, 102, 142) penetrates an opening (28, 68, 118, 156) in the base part (14, 54, 104, 144).

5. The packaging according to claim 3, wherein the cup is formed from the base part (14, 54, 104, 144) and the cup (24, 64, 114, 152) of the blister pack (12, 52, 102, 142) is arranged in the cup of the base part (14, 54, 104, 144).

6. A double pack that consists of two mirror symmetrically arranged part packings according to claim 1.

7. A multi-portion pack of at least two packings according to claim 1, wherein the individual packings are arranged next to each other in a strip pack (40, 90).

8. The multi-portion pack according to claim 7, wherein the individual packings form the strip pack (40, 90) along a weakening line.

9. The multi-portion pack, according to claim 8, wherein the weakening line is a perforation line (42, 92).

* * * * *